US006834922B2

(12) United States Patent
Cho

(10) Patent No.: US 6,834,922 B2
(45) Date of Patent: Dec. 28, 2004

(54) VEGETABLE COMPARTMENT IN REFRIGERATOR

(75) Inventor: Seok Hyun Cho, Changwon-shi (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 10/419,897

(22) Filed: Apr. 22, 2003

(65) Prior Publication Data

US 2003/0201700 A1 Oct. 30, 2003

(30) Foreign Application Priority Data

Apr. 24, 2002 (KR) ..... P10-2002-0022549

(51) Int. Cl.[7] ..... A47B 88/00
(52) U.S. Cl. ..... 312/331; 312/330.1; 312/408
(58) Field of Search ..... 312/330.1, 333, 312/295, 310, 401, 402, 408, 331

(56) References Cited

U.S. PATENT DOCUMENTS 2,711,944 A * 6/1955 Meek et al. ..... 312/333
2,724,630 A * 11/1955 Saunders ..... 312/408
2,897,035 A * 7/1959 Dorsey ..... 312/330.1
2,973,236 A * 2/1961 Hicks et al. ..... 312/408
4,775,075 A * 10/1988 Kamin et al. ..... 220/815
5,366,284 A * 11/1994 Baker et al. ..... 312/404
5,918,959 A * 7/1999 Lee ..... 312/404

* cited by examiner

*Primary Examiner*—Peter M. Cuomo
*Assistant Examiner*—Stephen Vu
(74) *Attorney, Agent, or Firm*—Fleshner & Kim, LLP

(57) ABSTRACT

A refrigerator compartment having a drawer-type container includes an opening in a top side thereof, and a first rail at a side surface thereof having sloped and horizontal parts. A partition member on the container has a first plate, a second plate, and a link member. The second plate covers an area of the opening of the container, and the first plate is connected to the second plate such that the first plate can pivot relative to the second plate. The link member extends from the first plate and contacts the first rail, for lifting the first plate as the link member moves up the sloped part of the first rail when the container is pulled out. The accessible area of the opening of the container is enlarged as the first plate moves up when the container is pulled out.

24 Claims, 5 Drawing Sheets

VEGETABLE COMPARTMENT IN REFRIGERATOR

This application claims the benefit of the Korean Application No. P2002-22549 filed on Apr. 24, 2002, which is hereby incorporated by reference.

BACKGROUND OF THE INVENTION

1. Field of the Invention

The present invention relates to a vegetable compartment in a refrigerator for fresh storage of vegetable.

2. Background of the Related Art

The refrigerator is an appliance for fresh, and long time storage of food. The refrigerator is provided with food storage chambers therein, which is always kept at a low temperature by means of a refrigerating cycle for maintaining a fresh state of the food.

The food storage chambers are provided with different characteristics so that the user selects a storage method suitable for different kinds of food taking kinds, characteristics and storage periods of the food into account. Of the food storage chambers, typical ones are the freezing chamber, the refrigerating chamber, and the vegetable compartment.

Of the storage chambers, the vegetable compartment is provided with optimal temperature and humidity for fresh storage of vegetable having a storage period shorter than processed food, always. The vegetable compartment is an independent space partitioned with a partition in the refrigerating chamber which is in general at a low temperature. A related art vegetable compartment in the refrigerator will be described.

The related art vegetable compartment in the refrigerator is a separate space partitioned from other space of the refrigerating chamber by a partition plate, also serving as a shelf, on a lower side of the refrigerating chamber. The vegetable compartment is provided with a container, top of which is opened, for putting vegetable therein. Since the container is right below the partition plate, the partition plate actually serves as a cover of the container, for covering the opened top side of the container.

For using the vegetable compartment, the user is required to open a door to the refrigerator, pull out the container, and put vegetable into the container through an inlet to the container, i.e., a part not covered with the partition plate of the opened top part of the container. However, if the container is pulled out longer than a predetermined length from the vegetable compartment, a bottom plate of the vegetable compartment can not support the contained. Therefore, for preventing the container from falling off the vegetable compartment, it is required that the pulling out length of the container is limited. However, the limitation of the pulling out length of the container substantially reduces a size of the inlet to the vegetable compartment too, which disables storage of large sized vegetable storage.

In the meantime, if it is intended to store large sized vegetable by all means, the user is required to cut the vegetable into pieces, or remove the partition plate, put the vegetable into the container and place the partition plate again.

However, the cutting of vegetable deteriorates freshness of the vegetable and can not keep proper tastes of the vegetable.

In the case of removal of the partition plate, since the partition plate also serves as a shelf, it is required to remove all the food stored on the partition plate, remove the partition plate, put the vegetable into the container, and return the partition plate and the food to original positions, which is very cumbersome.

SUMMARY OF THE INVENTION

Accordingly, the present invention is directed to a vegetable compartment in a refrigerator that substantially obviates one or more of the problems due to limitations and disadvantages of the related art.

An object of the present invention is to provide a vegetable compartment in a refrigerator, in which an inlet structure of a container is improved for convenient putting of large sized vegetable into the container.

Additional features and advantages of the invention will be set forth in the description which follows, and in part will be apparent from the description, or may be learned by practice of the invention. The objectives and other advantages of the invention will be realized and attained by the structure particularly pointed out in the written description and claims hereof as well as the appended drawings.

To achieve these and other advantages and in accordance with the purpose of the present invention, as embodied and broadly described, the vegetable compartment in a refrigerator includes a container, a guide member, and a partition member. The container has an opening in a top side for pushing in or pulling out of the refrigerator. The guide member is fitted to the container along a direction the container is pushed in or pulled out and has a sloped part adjacent to a door of the refrigerator, which is sloped such that the sloped part becomes the higher as it goes in a direction the container is pushed in. The partition member in the refrigerator for covering a top of the container has a first plate adjacent to the door for enlarging an opened area of the opening as the first plate moves up guided by the sloped part when the container is pulled out.

The guide member includes, for an example, at least one first rail fitted to a side surface of the container. The guide member includes, for an example, the sloped part, and a horizontal part extended from an end at a high side of the sloped part to a direction the container is pushed in.

The sloped part includes a moderate straight slope rising along a direction the container is pushed in, or a moderate curved slope rising along a direction the container is pushed in. The first rail is fitted to each of opposite side surfaces of the container.

The partition member includes, for an example, a second plate, a first plate, and a link member. The second plate provided to be pushed in or pulled out of the refrigerator, for covering a part of the opening of the container. The first plate connected to the second plate, such that the first plate can make relative motion with respect to the second plate, for enlarging the opened area of the opening when the container is pulled out. The link member extended a predetermined length from the first plate such that a part thereof is in contact with the first rail, for moving up or down the first plate when the container is pushed in or pulled out, respectively. The first plate and the second plate are coupled with a hinge, or connected with a connection member of a flexible material.

The partition member further includes, for an example, a second rail fitted to an underside of the first plate for making smooth sliding in a state a part of the container is in contact therewith when the container is pushed in or pulled out. In this instance, the container further includes, for an example, a second roller for making a contain movement smooth as the second roller is in contact with the second rail and slides thereon.

The partition member further includes, for an example, a stopper at an end of the second rail for preventing the second roller from failing off the second rail and limiting a maximum pulling out range of the container when the container is pulled out to the maximum.

The link member is, for an example, in contact with the guide member, and includes, for an example, a first roller for reducing friction between the guide member and the link member as the first roller rotates when the container is pushed in or pulled out.

The vegetable compartment in a refrigerator of the present invention further includes a supplementary contained under the container for pushing in or pulling out of the refrigerator.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENT

Reference will now be made in detail to the preferred embodiments of the present invention, examples of which are illustrated in the accompanying drawings. In describing the embodiments, same parts will be given same names and reference symbols, and repetitive description of which will be omitted.

Figure 1:
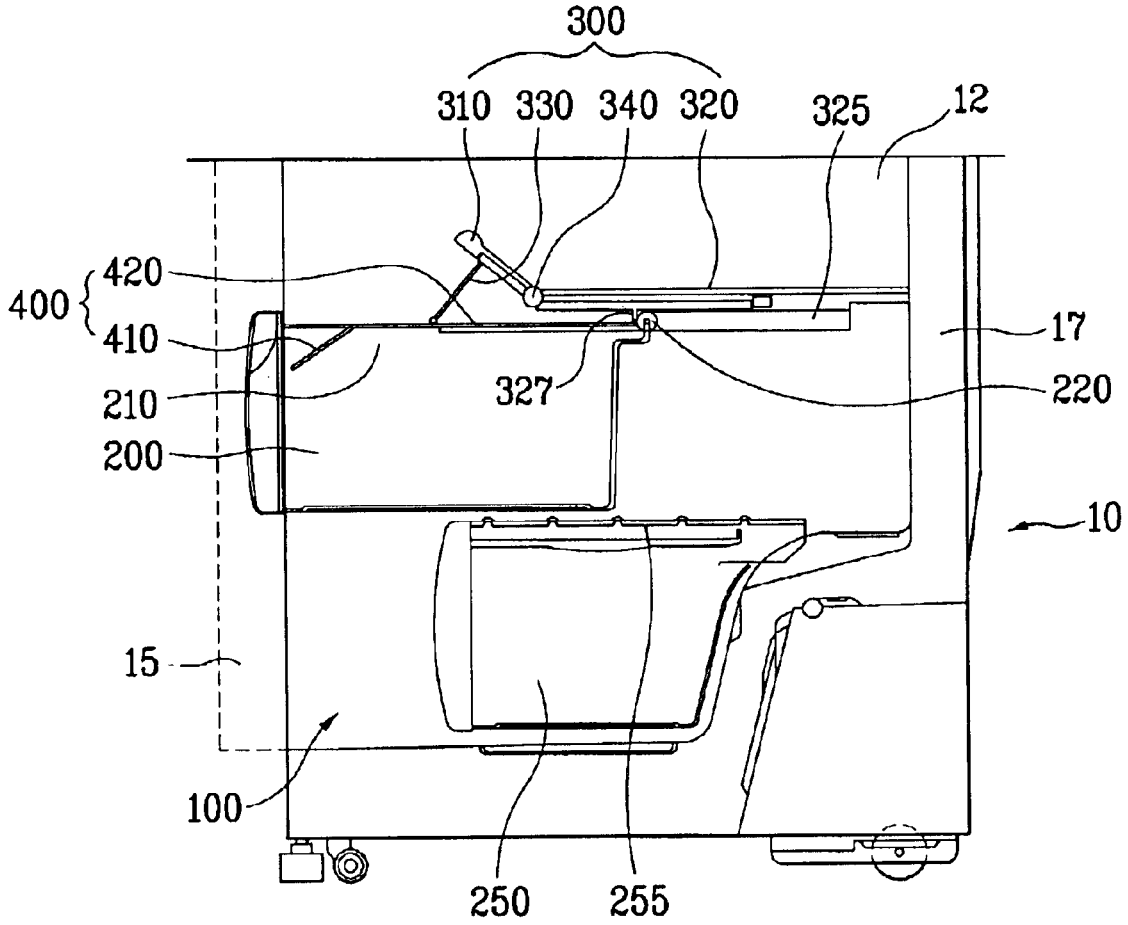
FIG. 1 illustrates a section showing one preferred embodiment of the present invention, schematically.

Referring to FIG. 1, the vegetable compartment of the present invention is a separate space partitioned from a refrigerating chamber 12 with a partition member 300 provided to the refrigerating chamber 12 in a refrigerator 10. The vegetable compartment 100 includes a container 200, a guide member, and the partition member 300.

An embodiment will be described in detail, in which the vegetable compartment is provided under the refrigerating chamber 12, with reference to FIG. 1. However, a position of the vegetable compartment 100 is not limited to under the refrigerating chamber 12, but may be a separate space partitioned with the partition member 300 and the container 200 in a middle part of the refrigerating chamber 12, if necessary. A detailed structure of the vegetable compartment is as follows.

Referring to FIG. 1, the container 200 is provided to be pushed in and pulled out of the refrigerator 10. The container has an opening 210 in a top side for putting/taking out vegetable.

In the meantime, the refrigerator designed to have a small capacity of the vegetable compartment 100 is provided with, for an example, one container 200, and the refrigerator designed to have a large capacity of the vegetable compartment 100 is provided with, for an example, a supplementary container 250 additionally as shown in FIG. 1. Of course, the supplementary container 250 has an opening in a top side, and, for maintaining freshness of the vegetable stored in the supplementary container 250, there is a cover 255 provided to the opening of the supplementary container 250 additionally for covering the opening of the supplementary container 250. A number of the supplementary containers provided thus are not limited.

The container 200 or the supplementary container 250 may be one piece or two or more pieces.

FIG. 1 illustrates an embodiment in which a guide member is a rail. However, the guide member is not limited to the rail, and the rail provided as the guide member is called as a first rail for convenience of description.

The first rail 400 provided as the guide member is provided to side surfaces of the container 200, for an example, inside or outside surfaces of the side surfaces of the container 200 along a direction the container 200 is pushed in or pulled out. One first rail may be provided to one of the side surfaces of the container 200, or one pair of the first rails may be provided to the side surfaces of the container 200.

The first rail provided thus includes a sloped part 410 and a horizontal part 420. As shown in FIG. 1, the sloped part 410 is provided to a part adjacent to the door 15 of the refrigerator 10 in the side surfaces of the container 200. The sloped part 410 is provided such that a horizontal height thereof becomes the higher as it goes the farther in a direction the container 200 is pushed in, in a direction of a rear wall 17 of the refrigerator 10 in a case of the embodiment shown in FIG. 1.

Figure 4:
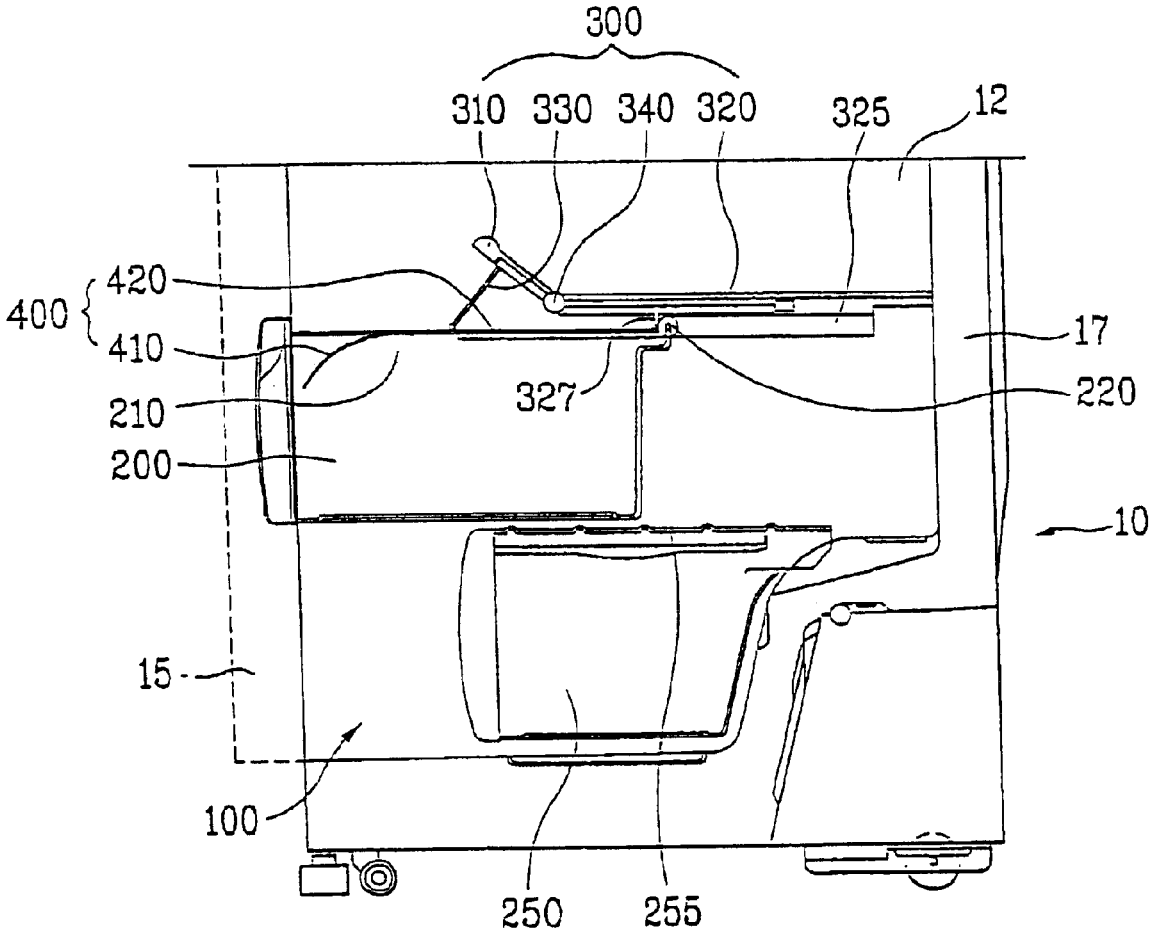
FIG. 4 illustrates a section showing an embodiment of the present invention.

Referring to FIG. 1, the sloped part 410 of the first rail 400 provided thus has a moderate straight slope rising in a direction the container 200 is pushed in. However, the sloped part 410 is not limited to this, but may have a moderate curved sloped part 410 in the direction the container 200 is pushed in, for example, as shown in FIG. 4.

Referring to FIG. 1, the horizontal part 420 of the first rail 400 is extended a predetermined distance from one end of the sloped part 410, in more detail, from one of ends of the sloped part 410 at a side a horizontal height is higher toward the direction the container 200 is pushed in.

Referring to FIG. 1, the partition member 300, provided to be pushed in/pulled out of the refrigerating chamber 12, partitions the vegetable compartment 100 from the refrigerating chamber 12. For supporting the partition member 300 in a state the partition member 300 is inserted in the refrigerating chamber 12, ledges (not shown) are projected from both sides of inside walls of the refrigerating chamber 12 in the refrigerator 10 along the direction the partition member 300 is inserted. Therefore, the partition member 300 is supported in a state both edges of the partition members 300 are placed on the ledges.

The partition member 300 serves, not only as a partition for separating the refrigerating chamber 12 from the vegetable compartment, but also as a shelf. That is, in a case of the embodiment shown in FIG. 1, since an upper space of the partition member 300 is the refrigerating chamber 12, if food is placed on the partition member 300, the partition member 300 serves as a shelf of the refrigerating chamber 12.

Moreover, since the partition member 300 is on top of the container 200, the partition member 300 covers the opening 210 of the container 200, serving to form an inside space of the container 200 as an independent space.

The partition member 300 with the foregoing services includes a first plate 310, a second plate 320, and a link member 330, of which details are as follows.

Referring to FIG. 1, the second plate 320, provided to be pushed in or pulled out of the refrigerating chamber 12, covers a part of the opening 210 of the container 200, i.e., a region adjacent to the rear wall 17 of the refrigerator 10. Since the second plate 320 serves as a shelf in a state inserted into the refrigerating chamber 12 fully, the second plate 320 has a flat top surface. It is preferable that the second plate 320 is fitted such that the second plate 320 does not move together with the container 200 when the container 200 is pulled out or pushed in.

The first plate 310 is connected to an end of the second plate 320 adjacent to the door 15 to the refrigerator 10, such that the first plate 310 can make relative motion with respect to the second plate 320. The first plate 310 and the second plate 320 are connected with a hinge 340 or a connecting member (not shown) of a flexible plastic. The connecting member includes a first end connected to the first plate 310 and a second end connected to the second plate 2.

Figure 2:
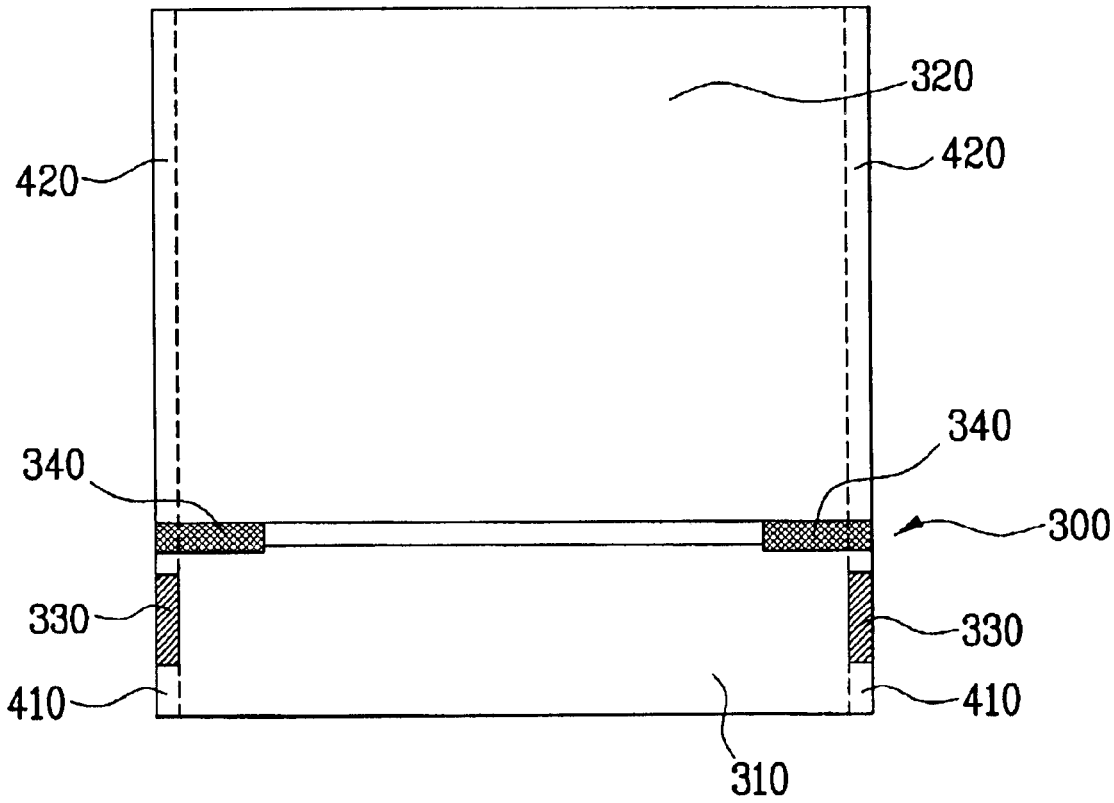
FIG. 2 illustrates a plan view of a vegetable compartment in FIG. 1, schematically.

Referring to FIG. 2, one pair of the hinges 340 or the connection members (not shown) may be provided for connecting both sides of a width direction of the first plate 310 or the second plate 320. However, the connection method is not limited to this, but one the hinge 340 or the connection member can be provided to connect a middle part of the width direction of the first plate and the second plate 320. Moreover, a plurality of the hinges 340 or the connection members may be provided at regular or irregular intervals along a width direction of the first plate 310 and the second plate 320.

Once the first plate 310 and the second plate 320 are connected with the hinge or the flexible connection member, the first plate 310 becomes rotatable with respect to the second plate 320 around the hinge or the connection member. As shown in FIG. 1, once the first plate 310 has the foregoing structure, the first plate 310 can enlarge an opened area of the opening 210 as an end of the first plate 310 adjacent to the door 15 moves up guided by the sloped part 410 when the container 200 is pulled out, and the first plate 310 can cover an opened area of the opening 210 fully as the end of the first plate 310 adjacent to the door 15 moves down guided by the sloped part 410 when the container 200 is pushed in.

In the meantime, when the container 200 is pushed in, or pulled out, the first plate 310 moves down or up as the first plate 310 rotates around the hinge. Therefore, no food is placed on the first plate 310, and, consequently, different form the second plate 320, the first plate 310 does not serve as a shelf.

Referring to FIG. 1, the link member 330 is extended from the first plate 310 for a predetermined length, for an example, such that an end thereof is in contact with the guide member, in the case of the first embodiment, the first rail 400. When one first rail 400 is provided, one link member 330 is extended from the first plate 310 so as to contact with the first rail 400. As shown in FIG. 2, when one pair of the first rails 400 are provided, one pair of the link members 330 are extended from the first plate 310 and in contact with the first rails 400, respectively.

A part where the link member 330 and the first plate 310 are joined are rigid unable to make a relative motion. The link member 330 and the first plate 310 may be attached after the link member 330 and the first plate 310 are fabricated as individual pieces, or may be formed as one unit.

If the link member 330 is extended from the first plate as above, the link member 330 and the first plate 310 are always movable altogether. That is, since the link member 330 is always in contact with the first rail 400 as above, the link member 330 moves up or down guided by the sloped part 410 and the horizontal part 420 of the first rail 400 when the container 200 is pushed in, or pulled out, according to which the first plate 310 rigidly joined with the link member 330 moves up or down as the first plate 310 rotates around the hinge 340. According to this, as shown in FIG. 1, when the container 200 is pulled toward the door side, the first plate 310 is lifted as the first plate 310 rotate upward, to enlarge an opening of the container 200, i.e., an opened area of the opening 210 actually. When the container 200 is pushed toward the rear wall 17 of the refrigerator 10, the link member 330 is moved down guided by the sloped part 410, and the first plate 310 is restored to an original position.

Meanwhile, the link member 330 may be provided with a roller for reducing friction with the guide member and making smooth relative motion between two members. For convenience of description, the roller provided to the link member 330 is called as a first roller 335.

The first roller 335 is provided to a contact part with the guide member, for an example, a contact part with the first rail 400 in the case of the embodiment shown in FIG. 1. In the case of FIG. 1, the first roller 335 is provided to an end of the link member 330. The first roller 335 provided thus keeps contact with the guide member, the first rail 400 in the case of the embodiment in FIG. 1, and rotates when the container is pulled out or pushed in, to reduce friction between the first rail 400 and the link member 330.

In the meantime, the vegetable compartment of the present invention is provided with a structure for making the pushing in and pulling out of the container 200 smooth. To do this, the partition member 300 includes a rail, and the container 200 includes a roller, further. For convenience of description, the rail provided to the partition member 300 is called as a second rail 325, and a rail provided to the container 200 is called as a second roller 220.

Referring to FIG. 1, the second rail 325 is fitted to an underside of the partition member 300, in more detail, underside of the second plate 320. The second rail 325 is fitted in the direction the container 200 is pushed in or pulled out, for guiding relative motion of the partition member 300 and the second plate 320 by designing a part of the container 200, for an example, the second roller 220, to slide smoothly in a state the second roller 220 is in contact with the second rail 325 when the container 200 is pushed in or pulled out.

The second roller 220 is provided to one side of the container 200, for an example, to a top side of the container 200 as shown in FIG. 1. The roller 220 is provided to, for an example, the top side of an end of the container 200 adjacent to the rear wall 17 of the refrigerator 10, for smooth guidance of the relative motion of the container 200 and the partition member 300 as the second roller 220 is in contact with, and slides on the second rail 325.

The vegetable compartment 100, having the structure for making smooth relative motion of the partition member 300 and the container 200 by means of the roller and the rail, further includes means for limiting a pulling out range of the container 200 while preventing falling off of the container 200. For this, the partition member 300 further includes a stopper 327.

Referring to FIG. 1, the stopper 327 is provided to an end of the second rail 325 adjacent to the door 15, for limiting a maximum pulling out range of the container 200 while preventing the second roller 220 from falling off the second rail 325 when the container 200 pulled out to the maximum.

The principle of enlargement/reduction of the opened area of the inlet to the container 200, i.e., the opening 210 in using the vegetable compartment 100 will be described with reference to FIGS. 3A~3B.

Figure 3A:
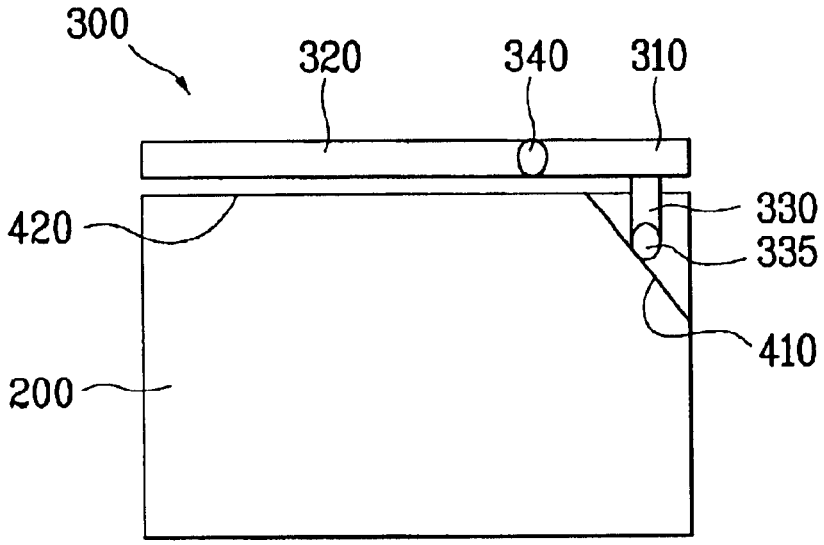
FIGS. 3A~3C illustrate the steps of a process for pulling out the container from the vegetable compartment in FIG. 1, schematically.

FIG. 3A illustrates a configuration of the partition member 300 and the container 200 when the container 200 is pushed in the vegetable compartment fully. In the case of FIG. 3A, the second plate 320 covers an area of the opening 210 in the container 200 in a state the second plate 320 is supported on the ledges on the inside wall of the refrigerating chamber 12. The first roller 335 of the link member 330 is in contact with a lower part of the sloped part 410, when the first plate 310 and the second plate 320 connected with the hinge 340 are leveled when seen from a side.

Figure 3B:
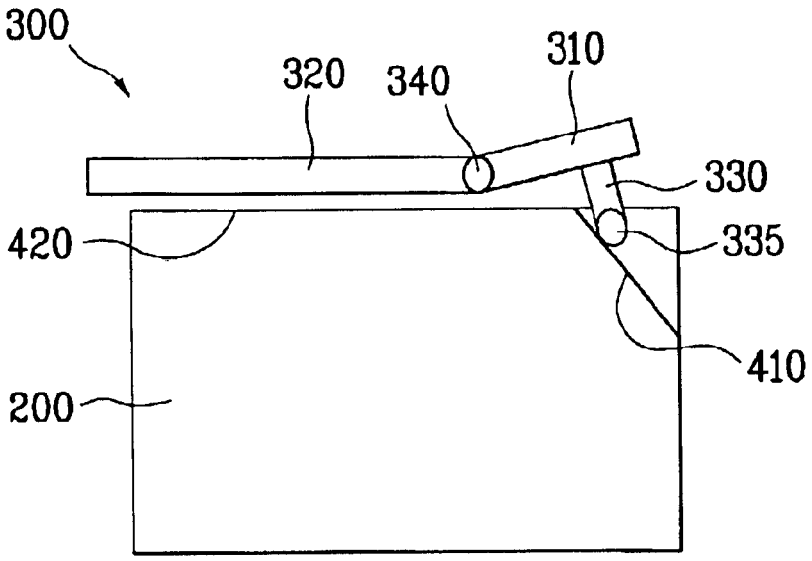

Under this state, if pulling out of the container 200 is started after the door 15 of the refrigerator 10 is opened, as shown in FIG. 3B, the link member 330 moves up guided by the sloped part 410, and, according to this, the first plate 310 rotates upward around the hinge 340. When the first plate 310 rotates upward around the hinge 340, the end of the first plate 310 adjacent to the door 15 is lifted, to enlarge the opened area of the inlet to the container 200, i.e., the opening 210, actually.

Figure 3C:
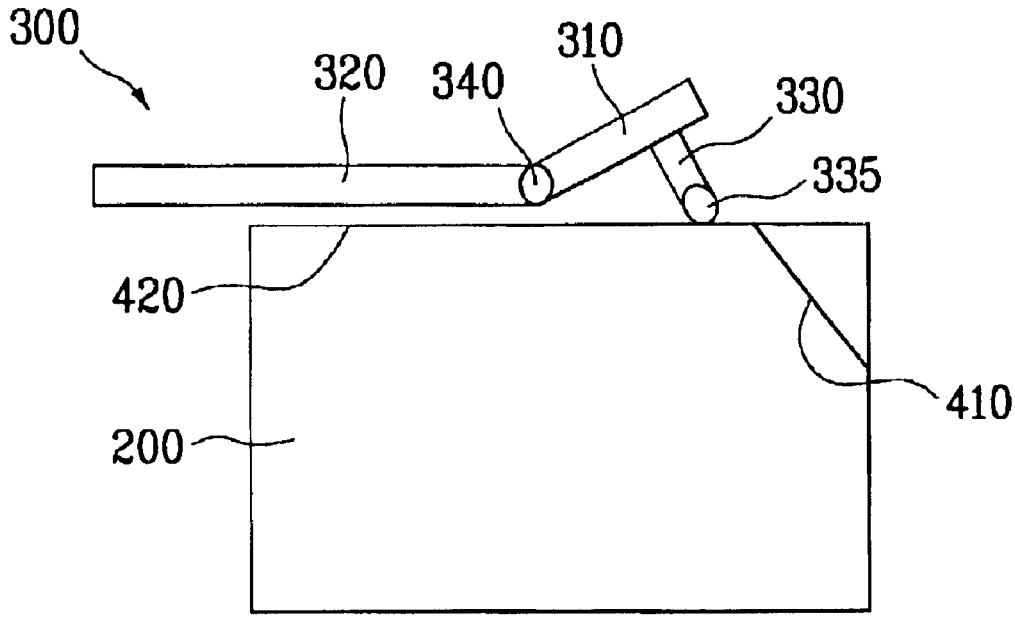

Then, as shown in FIG. 3C, when the container 200 is pulled out further, the link member 330 comes from the sloped part 410 to the horizontal part 420. After the link member 330 comes to the horizontal part 420 thus, only the container 200 is pulled out in a state the first plate 310 is left stationary.

When the container 200 is pulled out thus, since the first plate 310 moves up with a slope, to enlarge the opened area of the inlet of the container 200, i.e., the opening 210, even large sized vegetable can be put into the container 200 through the inlet of the container 200.

After the vegetable is stored in the container 200, the container 200 is pushed in toward the rear wall 17 of the refrigerator 10. When the container 200 is pushed in, the link member 330 is guided by the horizontal part 420 of the first rail 400, when the first plate 310 does not rotate. As the container 200 is pushed in further, the link member 330 comes from the horizontal part 420 to the sloped part 410, when the first plate 310 rotates to move downward. As shown in FIG. 3A, once the container 200 is pushed in fully, the first plate 310 is on the same plane with the second plate 320, and the opening 210 of the container 200 is covered by the first plate 310 and the second plate 320, fully.

The vegetable compartment 100 of the present invention enlarges the opened area of the opening 210 of the container 200 as the first plate 310 rotates upward around the hinge 340 when the container 200 is pulled out. The second plate 320 serves both as a shelf of the refrigerating chamber 12 and the cover on the opening 210 of the container 200.

In the present invention, a size of an area serving as the shelf for placing food thereon, and a size of the enlargeable opened area of the container 200 are fixed by adjusting sizes of the second plate 320 and the first plate 310 when a size of the partition member 300 is the same.

In the meantime, when the size of the first plate 310 is the same, the enlargeable opened area of the container 200 is fixed depending on an upward maximum rotation angle of the first plate 310. In this instance, the length of the link member 330 extended from the first plate 310, and an angle between the link member 330 and the first plate 310, a joint point of the link member 330 and the first plate 310, and a position and a sloped angle of the sloped part 410 are taken into account in the design.

Since the vegetable compartment in a refrigerator of the present invention enlarges the opened area of the container as a part of the partition member rotates upward in pulling out the container, the vegetable can be put into the container conveniently, even large sized vegetable can be put in.

It will be apparent to those skilled in the art that various modifications and variations can be made in the present invention without departing from the spirit or scope of the invention.

For an example, the guide means for guiding the link member is not limited to the rail.

As one example, if a system is designed such that a rail like long projection is formed on an inside or outside surface of the container, and the link member is made to contact with a top of the projection, the system will serve as the guide means, adequately.

As another example, if a system is designed such that a long groove is formed in the inside or outside surface of the container, and a part of the link member, such as the first roller is placed thereon, so that the link member moves with respect to the container in a state the first roller is placed in the groove, the system will serve as the guide means, adequately.

Thus, it is intended that the present invention cover the modifications and variations of this invention provided they come within the scope of the appended claims and their equivalents.

What is claimed is:

1. A compartment for use in a refrigerator comprising:

a container having an opening in a top side, for alternately pushing in and pulling out of the refrigerator;

a guide member fitted to the container along a direction the container is pushed in or pulled out having a sloped part proximate to a door of the refrigerator, the sloped part sloped such that the sloped part becomes higher in a direction the container is pushed in; and a partition member for at least partially covering the opening, having a first plate proximate to the door for enlarging an accessible area of the opening, wherein the first plate moves up guided by the sloped part when the container is pulled out.

2. The compartment as claimed in claim 1, wherein the guide member includes at least one first rail fitted to a side surface of the container, wherein the first rail includes:

the sloped part, and a horizontal part extended from an end at a high side of the sloped part to a direction the container is pushed in.

3. The compartment as claimed in claim 2, wherein the first rail is fitted to each of opposite side surfaces of the container.

4. The compartment as claimed in claim 2, wherein the sloped part includes a moderate straight slope rising along a direction the container is pushed in.

5. The compartment as claimed in claim 2, wherein the sloped part includes a moderate curved slope rising along a direction the container is pushed in.

6. The compartment as claimed in claim 2 wherein the partition member includes a link member extended a predetermined length from the first plate such that a part thereof is in contact with the first rail, for moving up or down the first plate when the container is pushed in or pulled out, respectively.

7. The compartment as claimed in claim 6, wherein the link member is in contact with the first rail, and includes a first roller for reducing friction between the first rail and the link member as the first roller rotates when the container is pushed in or pulled out.

8. The compartment as claimed in claim 1, wherein the partition member includes:

a second plate provided to be pushed in or pulled out of the refrigerator, for covering a part of the opening of the container, the first plate connected to the second plate, such that the first plate can make relative motion with respect to the second plate, for enlarging the opened area of the opening when the container is pulled out, and a link member extended a predetermined length from the first plate such that a part of the link member is in contact with the guide member, for moving the first plate downward when the container is pushed in and upward when the container is pulled out.

9. The compartment as claimed in claim 8, wherein the first plate and the second plate are coupled with a hinge.

10. The compartment as claimed in claim 8, wherein the first plate and the second plate are connected with a connection member of a flexible material, wherein the connection member includes:

a first end connected to the first plate, and a second end connected to the second plate.

11. The compartment as claimed in claim 8, wherein the link member includes a first roller for reducing friction between the guide member and the link member as the first roller rotates when the container is pushed in or pulled out.

12. The compartment as claimed in claim 8, wherein the partition member includes a partition rail fitted to an underside of the first plate for making smooth sliding in a state a part of the container is in contact therewith when the container is pushed in or pulled out.

13. The compartment as claimed in claim 12, wherein the container further includes a second roller for making a container movement smooth as the second roller is in contact with the partition rail and slides thereon.

14. The compartment as claimed in claim 13, wherein the partition member further includes a stopper at an end of the partition rail for preventing the second roller from falling off the partition rail and limiting a maximum pulling out range of the container when the container is pulled out to the maximum.

15. The compartment as claimed in claim 1, wherein the partition member further includes a partition rail fitted to an underside of the partition member, so that the container can make a smooth sliding in a state a part of the container is in contact with the partition rail in pushing in or puffing out of the container.

16. The compartment as claimed in claim 15, wherein the container further includes a second roller for making a container motion smooth as the second roller is in contact with the partition rail and slides thereon.

17. The compartment as claimed in claim 16, wherein the partition member further includes a stopper at an end of the partition rail for preventing the second roller from falling off the partition rail and limiting a maximum pulling out range of the container when the container is pulled out to the maximum.

18. The compartment as claimed in claim 1, further comprising a supplementary container under the container for pushing in or pulling out of the refrigerator.

19. A compartment for storing items in a refrigerator comprising:

a container having an opening in a top side, for pushing in or pulling out of the refrigerator;

at least one first rail fitted to a side surface of the container having a sloped part adjacent to a door of the refrigerator, the sloped part being sloped such that the sloped part becomes higher in a direction the container is pushed in, and a horizontal part extended from an end at a high side of the sloped part to a direction the container is pushed in; and a partition member including a second plate provided to be pushed in or pulled out of the refrigerator for covering a part of the opening of the container, and a first plate fitted to a part proximate to a door of the refrigerator, the first plate connected to the second plate, such that the first plate can make relative motion with respect to the second plate, for enlarging the uncovered area of the opening as the first plate moves up guided by the sloped part when the container is pulled out, and a link member extended a predetermined length from the first plate such that a part thereof is in contact with the first rail, for lowering and raising the first plate when the container is pushed in and pulled out, respectively.

20. The compartment as claimed in claim 19, further comprising:

a second rail fitted to an underside of the partition member, so that the container can make a smooth sliding in a state a part of the container is in contact with the second rail in pushing in or pulling out of the container;

a second roller for making a container motion smooth as the second roller is in contact with the second rail; and a stopper at an end of the second rail for preventing the second roller from falling off the second rail and limiting a maximum pulling out range of the container.

21. A storage compartment comprising:

a container having an access opening, wherein the container is configured to be displaceably disposed in a refrigerator;

a guide member formed on the container, the guide member including a first guide portion and a second guide portion, the first guide portion angled relative to the second guide portion, wherein the first guide portion is configured to be nearer than the second guide portion to a door-side of the refrigerator; and a partition member configured to be positioned over the container, the partition member including a first plate to at least partially cover the access opening, the first plate configured to move according to the first guide portion to a propped position above the access opening by displacement of the container toward the door-side of the refrigerator.

22. The storage compartment of claim 21, wherein the partition member further comprises a second plate to at least partially cover the access opening, wherein the first plate is configured to be nearer than the second plate to a door-side of the refrigerator, and wherein the first plate and the second plate are configured to be substantially planar when the container is in a stowed position.

23. The storage compartment of claim 21, wherein the partition member further comprises at least one rail formed on an underside of the partition member, wherein the at least one rail rides along the guide member, and wherein the at least one rail causes the partition member to assume the propped position as the container is displaced toward the door-side of the refrigerator.

24. The storage compartment of claim 21, further comprising a propping device having a first plate engagement portion and a guide member engagement portion, the guide member portion including a rotatable device that rides along the guide member.

* * * * *